United States Patent [19]

Gentry et al.

[11] 4,342,360

[45] Aug. 3, 1982

[54] ROD BAFFLED HEAT EXCHANGER

[75] Inventors: Cecil C. Gentry; William M. Small, both of Bartlesville, Okla.

[73] Assignee: Phillips Petroleum Company, Bartlesville, Okla.

[21] Appl. No.: 202,827

[22] Filed: Oct. 31, 1980

[51] Int. Cl.[3] ..... F28F 9/00; F28F 9/24

[52] U.S. Cl. ..... 165/67; 165/76; 165/159; 165/162

[58] Field of Search ..... 122/510; 165/76, 162, 165/159, 172, 178, 67

[56] References Cited

U.S. PATENT DOCUMENTS

| | | | |
|---|---|---|---|
| 2,229,344 | 1/1941 | Schneider | 165/162 |
| 2,433,731 | 12/1947 | Brinen | 165/76 |
| 3,259,112 | 7/1966 | Lee | 122/510 |
| 3,360,039 | 12/1967 | Frei | 165/67 X |
| 3,399,719 | 9/1968 | Forrest et al. | 165/162 X |
| 3,964,146 | 6/1976 | Vestre et al. | 165/162 X |
| 4,013,121 | 3/1977 | Berger et al. | 165/162 |
| 4,204,570 | 5/1980 | Eisinger | 165/172 X |
| 4,286,366 | 9/1981 | Vinyard | 165/162 X |

*Primary Examiner*—Sheldon J. Richter

[57] ABSTRACT

In a rod baffled tube and shell heat exchanger a rod having non-circular (e.g., elliptical) cross section allows easy assembly and firm engagement of the rods and the tubes by simple rotation of the rods around their axes.

46 Claims, 8 Drawing Figures

ROD BAFFLED HEAT EXCHANGER

BACKGROUND OF THE INVENTION

Figure 1:
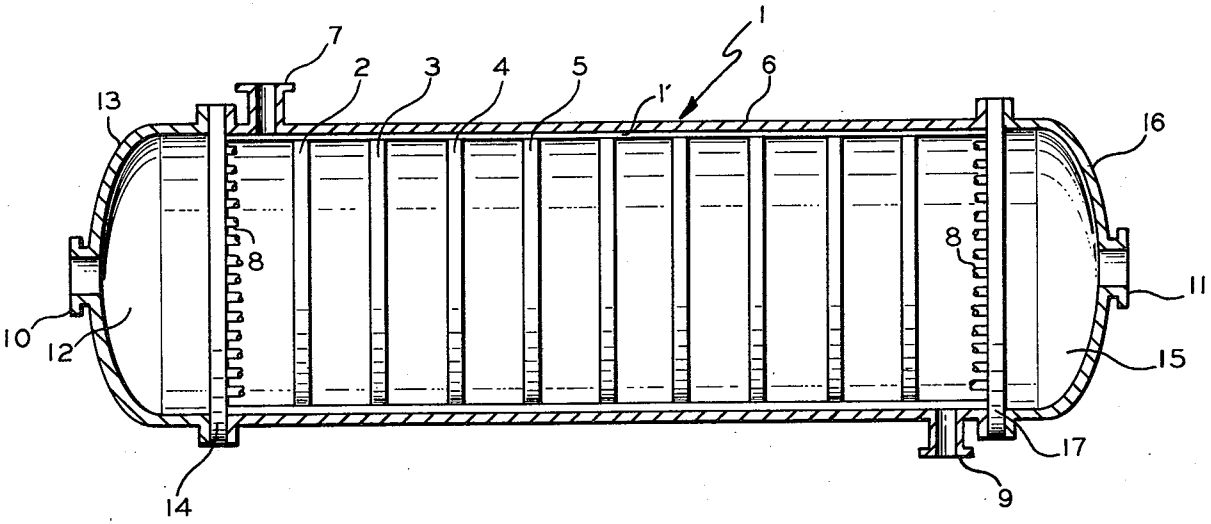
Figure 2:
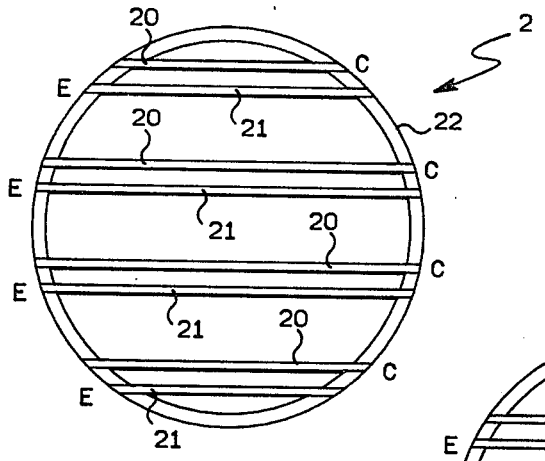
Figure 3:
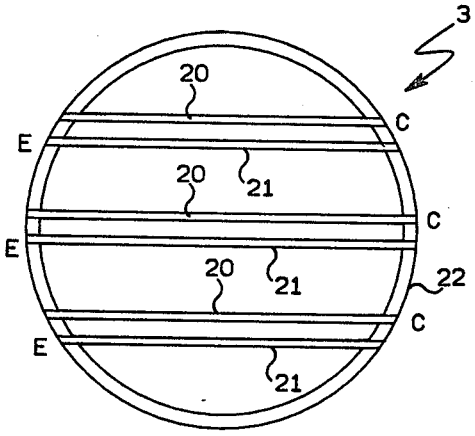
Figure 4:
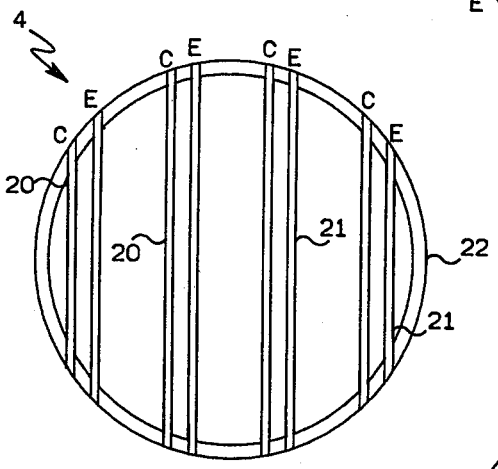
Figure 5:
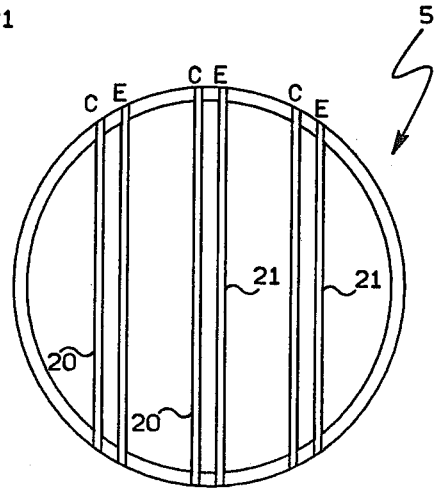

Various rod baffled heat exchangers have been disclosed in the art. Several of these heat exchangers have been put into successful practical application. One of the continuing problems in these heat exchangers is to establish a firm contact between the rods and the heat exchanger tubes. One proposal to solve this problem was to provide rods with areas of varying cross section and slide the rod so that an area of the rod having a small cross section is replaced by an area of a rod having a larger cross section between the tubes. Thereby the area of the rod with larger cross section gets into firm contact with the tubes. In this design rods are employed which have a special shape with alternating sections of smaller and larger cross sections. The rods also have to be longer than necessary for the heat exchanger in order to make possible the sliding movement.

THE INVENTION

It is one object of this invention to provide a rod baffle useful for heat exchangers with simple rods allowing, however, firm contact between the rods and the tubes.

Another object of this invention is to provide a heat exchanger incorporating such rod baffles.

A further object of this invention is to provide a process to produce heat exchangers.

Figure 6:
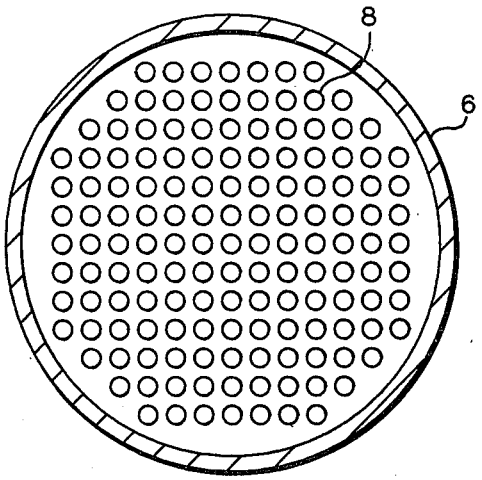
Figure 8:
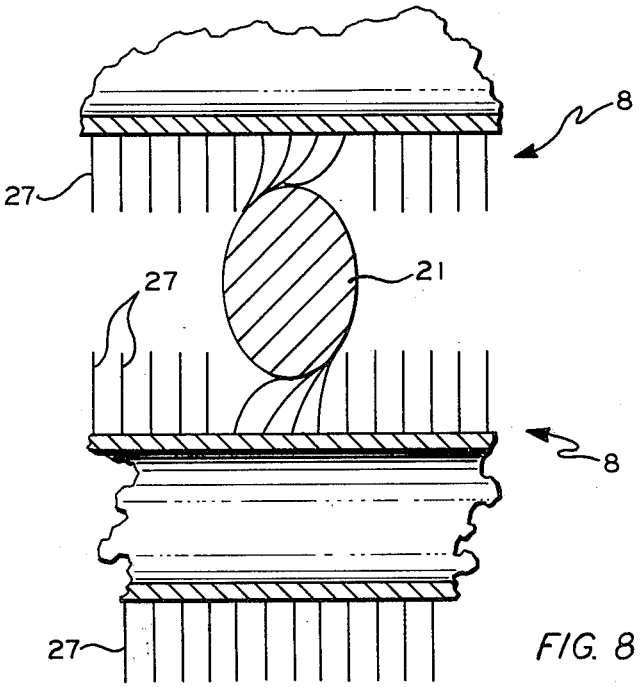
Figure 7:
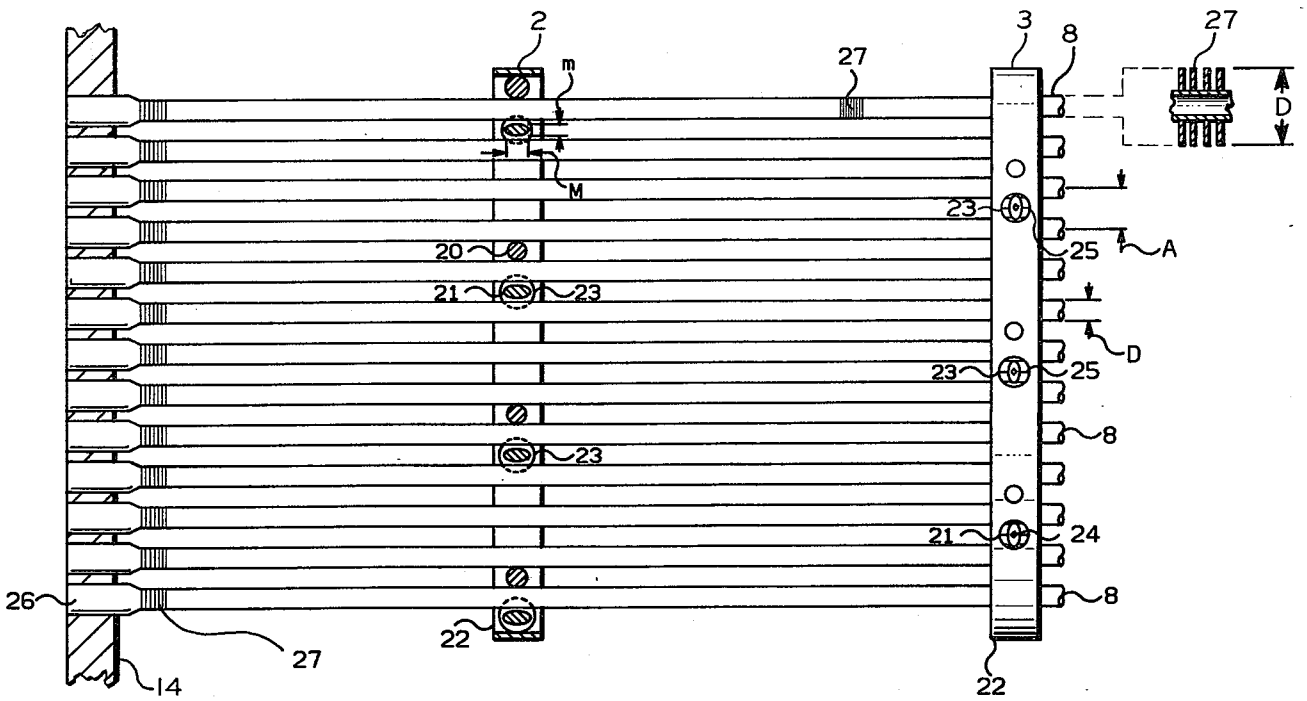

These and other objects, advantages, details, features, and embodiments of this invention will become apparent to those skilled in the art from the following detailed description of the invention, the appended claims and the drawing in which:

FIG. 1 is a view of a tube and shell heat exchanger showing the shell in cross-sectional view, FIGS. 2, 3, 4 and 5 are views of four rod baffles which together establish radial support of every tube in the heat exchanger, FIG. 6 is a schematic cross-sectional view showing a tube arrangement in a square pitch of a heat exchanger, FIG. 7 shows an enlarged sectional view illustrating the shape and position of the rods of non-circular cross section prior to and after the final installment, and FIG. 8 shows a cross-sectional view of a rod of non-circular cross section in operating position, depressing the fins on the finned tubes adjacent one another.

In accordance with this invention a rod baffle is provided wherein non-circular cross sections of rods allow the firm engagement of such rods with, e.g., heat exchanger tubes by a simple rotation of such rods around their axis.

In accordance with a first embodiment of this invention rod baffle is provided which comprises a plurality of parallel rods. At least some of these rods have a non-circular cross section at least in some areas along the rod. The rods are shaped so that the distance between parallel tangent planes being parallel to the rod axis and touching the rod surface varies from a smallest extension to a largest extension around the rod. The so-shaped rods are readily inserted between tube rows of a heat exchanger with the largest extension arranged parallel to the tube axis and the smallest extension arranged orthogonally to the tube axis. When turning the rod engages the rod in firm contact with the tubes. The rods, therefore, are arranged for rotation in the baffle and after their installment are fixed in the baffle against any unplanned rotation. Preferably, the largest extension of the non-circular cross section is equal to or larger than the average "free" space or distance between adjacent tubes.

Preferably the rods with the non-circular cross section have a surface defined by a non-circular cylinder. In this embodiment the cross section of the rods is the same along the entire rod. Here, too, the distance of parallel tangent plains varies around the rod from a smallest to a largest extension. The cross-sectional shape of this circular cylinder in the simplest form is elliptical although other shapes are also useful.

The non-circular cylinder can be defined as a surface obtained by moving a straight line in parallel along a closed non-circular curve. This curve preferably has no uncurved areas so that the rods have a convex shape.

Not all of the rods of the rod baffle have to be of the non-circular cross section. It is preferred that rods of circular cross section and rods of non-circular cross section alternate in the rod baffle. It is, however, within the scope of this invention that all the rods are of the non-circular cross section structure.

The rod baffle further comprises a baffle support to which the rods are attached. This baffle support prior to the installation of the rod baffle allows the rotation of the rods having the non-circular cross section. After the final installation of the rod baffle at least some of the non-circular cross section rods are fixedly attached to the baffle support to prevent any rotation of the rods so attached in the baffle.

In accordance with one embodiment of this invention the rod baffle may contain one or more rods of non-circular cross section which remain rotatable in the baffle even after installation in the heat exchanger to allow an adjustment of the flow resistance of the rod baffle in the heat exchanger.

At least one end of the rods of non-circular cross section is provided with means for applying a torque around its axis to the rod. This torque will rotate the rod into contact, e.g., with heat exchanger tubes. One such means would be a polygonally shaped recess in the end of the rod. Another possibility would be to form the end of the rod in a polygonal shape such as a hexagon so that cranks or wrenches can be used to turn these rods. Preferably the rods are provided with such means for rotating at both ends of the rod.

The baffle also comprises fixing means to securely hold the rod of non-circular cross section in position after the installment. The fixing means can, for instance, be spot welds.

A second embodiment of this invention is a heat exchanger. This heat exchanger comprises a plurality of parallel tubes which are arranged in a plurality of parallel rows. At least one rod baffle comprising a plurality of parallel rods arranged between adjacent tube rows with each rod contacting the tubes of at least one row is provided for. This rod baffle contains rods with non-circular cross section which have been rotated into contact with the rows of the tube row. These rods are as defined in more detail above in connection with the rod baffle.

The rod baffle preferably comprises a rod support surrounding the plurality of parallel tubes in which the non-circular cross section rods could be rotated around the rod axis and into firm engagement with the tubes prior to the installment and to which the rods have been rigidly attached after such rotation. The rod support means can be a simple ring surrounding the tube bundle.

In order to provide optimum mechanical and flow properties of the heat exchanger it is presently preferred to have a plurality of rod baffles meshing with the tube rows. Most preferably there is at least one set of rod baffles providing radial support for the tubes. To provide radial support for a tube requires at least three non-parallel rods (non-parallel with respect to the tubes). Typically in a square pitch arrangement of the tubes four rods provide the radial support for one tube. Each rod provides support for a plurality of tubes. By "radial support" an arrangement is meant wherein three or more non-parallel rods contact a tube so that this tube cannot be moved in any radial direction. The radial support prevents excessive movement of the tube of the heat exchanger and is, therefore, desirable.

The rods of the rod baffle are arranged non-parallel and at a substantial angle to the tube axis. For simplicity of design and construction it is oftentimes preferred that the rods are arranged under 90° with respect to the tube. Individual rod baffles providing radial support for tubes in a square pitch of the tube arrangement have their rods oftentimes arranged at 90° with respect to the rods of the other baffle. In the case of a triangular pitch of the tubes the rods from one baffle are arranged at, e.g., 60° with respect to the rods of another baffle.

In some applications the tubes of the heat exchanger are provided with end sections having a diameter larger than the diameter of the middle part of the tubes. Furthermore, it is particularly preferred for the present invention that the tubes of the heat exchanger are provided with fins. These fins can be of a variety of shapes and designs. The fins may be ring shaped disks spaced along the tube axis. The fins may be helical or longitudinally arranged along the tube. In each instance the rods of non-circular cross section are rotated into contact with the fins and exert their stabilizing pressure on these fins. For ease of assembly it is presently preferred that the distance between adjacent fin sections measured in axial direction along the individual tube is substantially smaller than the smallest extension of the non-circular cross section of the rod. Thereby it is made certain that the rod when rotated into contact with the fins on the tube will always find a plurality of fins to which the stabilizing pressure is exerted. In the case of elliptical rods the axial distance of fins or fin sections may be about ½ times the length of the minor axis of the ellipse or less. A typical "fin density" would be 10 to 35 fins per inch, an example being 19 fins per inch.

It is not necessary but presently preferred that the rods are arranged in groups in which rods with circular cross section alternate with rods with non-circular cross section in the series of open spaces between the tube rows. Advantageously such a group of alternating circular and non-circular cross section rods is subdivided into a first and a second subgroup. The rods of each of these subgroups are parallel and arranged essentially in one plane. The plane of the first subgroup and the plane of the second subgroup are axially displaced with respect to each other along the tube axis. In the case of a square pitch of the tubes it is preferred to have two groups each subdivided into the two subgroups described arranged so that the rods of one group are 90° with respect to the rods of the other group and so that the rods of the two groups provide radial support for each tube. The arrangement of the rods in the subgroups may be such that in each subgroup two rods and two empty spaces between tube rows alternate. It is, however, also within the scope of this invention that one rod and one empty space alternate in each of the subgroups.

The tubes in the tube and shell heat exchanger of this invention may be individual tube sections that are attached at both ends to a tube sheet or these tubes may be hair pin type tubes which are bent and attached at both ends to the same tube sheet. The shape and function of the non-circular rods in both instances remains essentially unchanged.

The smallest and the largest extension of the cross section of the non-circular rod is related to the free distance between the tube rows or respectively between the fin surface. The term "fin surface" is intended to describe an imaginary surface or cylinder tightly surrounding all the fin edges. The smallest extension of the non-circular cross section rod is smaller than the free distance between the tube rows or the fin surfaces. The largest extension of the non-circular cross section of the rod is at least equal to and preferably larger than the free distance described. This free distance in the case of a square pitch of tubes is equal to the difference of the axial distance of adjacent tubes and the diameter of one tube; this diameter again refers to either the tube diameter or the outside diameter of the fins.

In accordance with a third embodiment of this invention a process for manufacturing a tube bundle useful in a tube and shell heat exchanger is provided for. This process comprises insertion of a rod of non-circular cross section between two parallel rows of the tube. The rod of non-circular cross section is as defined above. The rod is inserted between two parallel rows of tubes so that the largest cross sectional extension extends in the direction of the tube longitudinal axis. Thus the rod of non-circular cross section is easily slipped in between adjacent tube rows. Then the rod is rotated around its axis and into firm engagement with at least one of the tube rows. Finally the rod of non-circular cross section is fixedly attached at its ends to a rod support means to prevent any further rotation of this rod. The above described preferred geometrical and structural embodiments of the heat exchanger are also preferred in the application of the process of this invention.

The following detailed description of the drawing is intended to show further preferred features of this invention without undue limitation of its scope.

FIG. 1 shows partially in cross section a tube and shell heat exchanger. A rod baffled tube bundle 1 is surrounded by shell 6. The tubes in the tube bundle 1 are supported by a plurality of rod baffles 2, 3, 4, 5 with slide bars 1'. One fluid enters the shell side of the tube and shell heat exchanger through an inlet 7 and after heat exchange with the fluid in the tubes 8 (FIG. 6) leaves the shell side via exit 9. The fluid flowing through the tubes 8 enters the heat exchanger via inlet 10 and leaves the heat exchanger via outlet 11. This fluid flows from chamber 12 which is defined by the end section 13 of the heat exchanger and the tube sheet 14 through the tubes 8 and into the other end chamber 15 which is similarly confined by the end section 16 and the other tube sheet 17.

The tubes 8 as shown in FIG. 6 can be arranged in a square pattern. The tubes 8 are kept in position by a plurality of rod baffles 2, 3, 4, 5, etc. These rod baffles as shown in more detail in FIGS. 2–5 each comprise a plurality of circular rod 20 and rods of elliptical cross section 21. To illustrate this further the letters "C" and "E" have been written next to the individual rods to indicate their cross-sectional shape. These rods are rigidly attached, e.g., by spot welding to a ring 22. The rods of the baffles 2 and 3 are parallel and the rods of baffles 4 and 5 are parallel. Baffles 2 and 3 are axially spaced and so are baffles 4 and 5. The rods of baffles 2 and 3 are arranged at 90° with respect to the rods of baffles 4 and 5.

The invention is a partial side view in FIG. 7. In this figure the baffle 2 is shown in the position prior to the rotation of the elliptical rods and baffle 3 is shown in a position after the rotation of the elliptical rods into firm contact with the tubes 8. The rods 20 and 21 are shown in the drawing with the support ring 22. In baffle 2 the rods 21 are shown as inserted between the tubes 8. Ring 22 is provided with a circular opening 23 to allow turning of the rod 21 having essentially elliptical cross section. Prior to the turning of the elliptical rods 21 there is a gap between the tubes and the rods. After the rods 21 with elliptical cross section have been turned into firm contact with the tubes all the rods engage firmly with the adjacent tube rows. This is shown in the case of the baffle 3 in FIG. 7. The rods in baffle 2 of FIG. 7 are shown in cross sectional view whereas the rods in baffle 3 of FIG. 7 are shown in end view. The ends of the rods 21 are provided with a square to rectangular recessed area 24 in which a tool can be inserted for rotating these rods. In connection with the baffle 3 in FIG. 7 there is also schematically shown the spot welding connection 25 between the rod 21 and the ring 22. Rods 20 also pass through holes, not numbered, in rod support rings 22, and are welded to rings 22, as illustrated for rods 21.

The tubes 8 have a wider end section 26 at tube sheet 14 (and 17, not shown in FIG. 7). The tubes are also provided with fins 27 as shown in more detail in a partial cross sectional view in FIG. 7. When the elliptical rods 21 are turned 90° to wedge the tubes 8 contacting their fins 27 a slight deformation of these fins by the wedging elliptical rod 21 may occur, as shown in FIG. 8.

The rod 21 with elliptical cross section is slipped through the hole 23 the diameter of which is at least as large as the maximum extension of the non-circular cross section in the specific instance at least as large as the major axis of the elipse. After the rotation of the rod with elliptical cross section, e.g., by 90° and into bind with the fins of adjacent fin tubes the ends of elliptical rod 21 are spot or tack welded to the support rings 22.

Labeling the major axis (M) and the minor axis (m) of the elliptical cross section of the non-circular cross section rod 21 the tube values are related to the distance (A) of the axis of adjacent tubes and the "diameter" (D) of tube 8 (in this case the diameter of the fins) for the embodiment of a square pitch of the tubes as follows:

$$m<(A-D)$$

$$M\geqq(A-D).$$

FIG. 8 shows in cross section, a non-circular rod 21 positioned between two adjacent tubes 8 so that a portion of the fins 27 on each tube is deformed, so as to effect the desired contact and tubes support with a minimum disruption of the fins 27 on tubes 8. FIG. 8 shows an operating position of rod 21 holding tubes 8.

In a typical heat exchanger the fin "diameter" D of finned tube 8 would be 0.726 inch. The outside diameter of the tube without fins is 0.625 inch. Each fin height (from the base or root) is 0.0505 inch. There are 19 fins per lineal inch.

The distance A between adjacent tubes would typically be one inch. The plain end diameter is $\frac{3}{4}$ inch; square pitch is used.

The rod 20 would have a diameter of $\frac{1}{4}$ inch, and the rod 21 would have an elliptical cross section with the major axis M being $\frac{3}{8}$ inch and the minor axis m being $\frac{1}{4}$ inch.

The usual materials are employed for the construction of the rod baffle heat exchanger such as stainless steel for the tubes and rods. Finned tubes are commercially available under the trademark "Wolverine S/T type fin tubes".

Although FIG. 7 shows openings 23 in rod support means 22 for the rods 21, and shows openings (not numbered) in rod support means 22 for rods 20, it is pointed out that rods 20 and 21, at their respective ends, after being properly positioned in the tube bundle, can be welded to a radial surface of means 22. A radial surface of means 22 is a surface of means 22 lying in an imaginary plane which is substantially perpendicular to the longitudinal axes of tubes 8.

Reasonable variations and modifications which will become apparent to those skilled in the art can be made in this invention without departing from the spirit and scope thereof.

We claim:

1. A rod baffle comprising a plurality of parallel rods at least some of said rod having a surface defined by a non-circular elliptical cylinder, the cross section of these rods being the same along the entire rod, and the distance between parallel, tangent planes being parallel to the rod axis and touching the rod surface varying from a smallest extension to a largest extension around the rod.

2. Rod baffle in accordance with claim 1 wherein rods of circular cross section and rods of non-circular cross section alternate.

3. Rod baffle in accordance with claim 2 wherein the small axis of the elliptical cross section is equal to or smaller than and the large axis of the elliptical cross section is larger than the diameter of the circular cross section.

4. Rod baffle in accordance with claim 1 further comprising a rod support to which the rods are attached.

5. Rod baffle in accordance with claim 4 wherein at least prior to installation said rods having non-circular cross section are arranged for rotation around the axis to thereby change the distance of two parallel stationary planes touching the rod surface.

6. Rod baffle in accordance with claim 1 wherein at least one end of said rods of non-circular cross section is provided with means for applying a torque around its axis to said rod.

7. Rod baffle in accordance with claim 6 wherein said means comprise a polygonally shaped end section of said rod.

8. Rod baffle in accordance with claim 1 wherein said baffle further comprises fixing means to securely hold the rotatably arranged rod of the non-circular cross section in position after the installment of the rod baffle.

9. A rod baffle comprising a plurality of parallel rods at least some of these rods having a non-circular cross section at least in some areas along the rod, with the distance between parallel tangent planes being parallel to the rod axis and touching the rod surface varying from a smallest extension to a largest extension around the rod, said rods being arranged in said baffle for rotation around the axis of the rod to enable the adjustment of the space between neighboring rods and the engagement or disengagement of such rods with adjacent elements.

10. Rod baffle in accordance with claim 9 wherein said non-circular cross section is defined by a convex surface.

11. Rod baffle in accordance with claim 9 wherein said cross section is essentially elliptical.

12. Rod baffle in accordance with claim 9 wherein rods of circular cross section and rods of non-circular cross section alternate in said baffle.

13. Rod baffle in accordance with claim 12 wherein said non-circular cross section is elliptical and wherein the small axis of the elliptical cross section is equal to or smaller than and the large axis of the elliptical cross section is larger than the diameter of the circular cross section.

14. Rod baffle in accordance with claim 9 further comprising a rod support to which the rods are attached.

15. Rod baffle in accordance with claim 14 wherein at least prior to the installation said rods having non-circular cross section are arranged for rotation around the rod axis to thereby change the distance of two parallel stationary planes touching said rod.

16. Rod baffle in accordance with claim 9 wherein at least one end of said rods of non-circular cross section is provided with means for applying a torque around the axis of said rod.

17. Rod baffle in accordance with claim 8 wherein said means comprise a polygonally shaped end section of said rods.

18. Rod baffle in accordance with claim 9 wherein said baffle further comprises fixing means to securely hold the rotatably arranged rod of non-circular cross section in position after the installment.

19. Heat exchanger comprising (a) a plurality of parallel tubes, said tubes being arranged in a plurality of parallel rows, (b) at least one rod baffle comprising a plurality of parallel rods arranged between adjacent rows, each rod contacting the tubes of at least one row, at least some of these rods having a non-circular cross section at least in some areas along the rod, with the distance between parallel tangent planes being parallel to the rod axis and touching the rod surface varying from a smallest extension to a largest extension around the rod, and with said rods having a non-circular cross section being arranged in said baffle for said rotation around the axis of the rod to enable the adjustment of space between neighboring rods and the engagement or disengagement of such rods with other elements.

20. Heat exchanger in accordance with claim 19 wherein said rods of non-circular cross section have a surface being defined by a non-circular cylinder with the cross section of these rods being the same along the entire rod.

21. Heat exchanger in accordance with claim 19 wherein said cross section of said rod having a non-circular cross section is essentially elliptical.

22. Heat exchanger in accordance with claim 19 wherein rods of circular cross section and rods of non-circular cross section alternate.

23. Heat exchanger in accordance with claim 19 comprising a rod support means with respect to which the rods of non-circular cross section could be rotated around the rod axis and into firm engagement with the tubes prior to the attachment support means to which the rods have been rigidly attached after such rotation.

24. Heat exchanger in accordance with claim 23 wherein said rod support means comprise a ring surrounding the tubes.

25. Heat exchanger in accordance with claim 19 comprizing a plurality of rod baffles.

26. Heat exchanger in accordance with claim 19 wherein at least one set of rod baffles provides radial support for the tubes.

27. Heat exchanger in accordance with claim 19 wherein said tubes are arranged in a square pitch and wherein at least two rod baffles support the tubes with the proviso that the rods of one rod baffle are arranged at 90° with respect to the rods of the other rod baffle.

28. Heat exchanger in accordance with claim 19 wherein the tubes comprise end sections having a diameter larger than the diameter of the middle part.

29. Heat exchanger in accordance with claim 28 wherein the largest extension of the non-circular cross section is at least as large as the free distance between adjacent tube rows and wherein the smallest extension of the non-circular cross section is smaller than the free distance between adjacent tube rows.

30. Heat exchanger in accordance with claim 19 wherein said non-circular cross section is elliptical and wherein the small axis of the elliptical cross section is equal to or smaller than and the large axis of the elliptical cross section is larger than the diameter of the circular cross section rod.

31. Heat exchanger in accordance with claim 30 wherein said rods after said rotation are spot welded to said support means.

32. Heat exchanger in accordance with claim 30 wherein said tubes are provided with fins.

33. Heat exchanger in accordance with claim 31 wherein said rods with non-circular cross section when rotated contact said fins exerting stabilizing pressure on these fins.

34. Heat exchanger in accordance with claim 31 wherein the distance between adjacent fin sections measured in axial direction along the individual tube is substantially smaller than the smallest extension of said non-circular cross section of said rod.

35. Heat exchanger in accordance with claim 19 comprising a group of parallel rods between parallel tube rows with the proviso that in the series of open spaces between the tube rows rods with circular cross section and rods with non-circular cross section alternate.

36. Heat exchanger in accordance with claim 35 wherein said group is subdivided into a first and a second subgroup, wherein each of said subgroups is composed of mutually parallel rods arranged essentially in one plane, with the proviso that the plane of the first subgroup and the plane of the second subgroup are axially displaced with respect to each other.

37. Heat exchanger in accordance with claim 35 wherein in each of said subgroups two rods and two empty spaces between tube rows alternate.

38. Heat exchanger in accordance with claim 35 comprising at least two groups of parallel rods, the rods in each group being at a substantial angle with respect to the rods of the other group or groups.

39. A process for manufacturing a tube bundle useful for a tube and shell heat exchanger comprising (a) inserting a plurality of parallel cylindrical rods at least some of these having non-circular convex cross section between two parallel rows of tubes so that the largest extension of said non-circular cross section measures in the direction of the tube axis or at least in a plane parallel to the tube rows, with the proviso that the smallest extension of said non-circular cross section is smaller than the free distance between the tube rows and the largest extension of said non-circular cross section is equal to or larger than said free distance, so that the rods having non-circular cross section after the insertion are arranged between the parallel tube rows non-parallel to the tube axis and at a substantial angle with respect to the tube axis, (b) rotating said cylindrical rods having non-circular cross section around their axis into firm engagement with at least one of said tube rows, and (c) fixedly attaching the ends of the so rotated rods to a rod support means such as to prevent the rods from further rotation.

40. Process in accordance with claim 39 wherein said rod of non-circular cross section is rotated into firm contact with both tube rows between which it had been inserted.

41. A process in accordance with claim 39 comprising inserting a plurality of rods between tube rows such as to provide radial support for each tube.

42. Process in accordance with claim 41 comprising inserting a group of parallel rods between parallel tube rows with the proviso that in the series of open spaces between the tube rows rods with circular cross section and rods with non-circular cross section alternate.

43. Process in accordance with claim 42 wherein said group is subdivided into a first and a second subgroup, wherein each of said subgroups is composed of parallel rods arranged essentially in one plane, the plane of said first subgroup and of said second subgroup being axially displaced with respect to each other.

44. Process in accordance with claim 43 wherein in each of said subgroups two rods and two empty spaces between tube rows alternate.

45. Process in accordance with claim 43 wherein at least two groups of parallel rods are provided for, the rods in each group being at a substantial angle with respect to the rods of the other group or groups.

46. Process in accordance with claim 39 wherein said rods are spot welded to said support means.

* * * * *

UNITED STATES PATENT AND TRADEMARK OFFICE

CERTIFICATE OF CORRECTION

PATENT NO. : 4,342,360

DATED : August 3, 1982

INVENTOR(S) : Cecil C. Gentry; William M. Small

It is certified that error appears in the above—identified patent and that said Letters Patent is hereby corrected as shown below:

Col. 7, Claim 17, line 34, "8" should be --- 16 ---.

Col. 8, Claim 33, line 41, "31" should be ---32 ---.

Col. 8, Claim 34, line 45, "31" should be --- 32 ---.

Signed and Sealed this

*Fourteenth* Day of *December 1982*

[SEAL]

*Attest:*

GERALD J. MOSSINGHOFF

*Attesting Officer*

*Commissioner of Patents and Trademarks*